US009744768B2

(12) United States Patent
Ono et al.

(10) Patent No.: US 9,744,768 B2
(45) Date of Patent: Aug. 29, 2017

(54) LIQUID EJECTING APPARATUS WITH INK RECEIVING TRAY AND DETECTOR

(71) Applicant: SEIKO EPSON CORPORATION, Tokyo (JP)

(72) Inventors: Hirokazu Ono, Suwa (JP); Kenji Tsukada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/934,750

(22) Filed: Nov. 6, 2015

(65) Prior Publication Data

US 2016/0129692 A1 May 12, 2016

(30) Foreign Application Priority Data

Nov. 10, 2014 (JP) ..... 2014-227809

(51) Int. Cl.
*B41J 2/165* (2006.01)
*B41J 2/175* (2006.01)

(52) U.S. Cl.
CPC ..... *B41J 2/165* (2013.01); *B41J 2/175* (2013.01)

(58) Field of Classification Search
CPC ..... B41J 2/165; B41J 2/175
See application file for complete search history.

(56) References Cited

U.S. PATENT DOCUMENTS

| | | | | |
|---|---|---|---|---|
| 6,328,414 | B1 | 12/2001 | Yoshino | |
| 2006/0092240 | A1 * | 5/2006 | DeVries | B41J 2/1714 347/84 |
| 2007/0097160 | A1 * | 5/2007 | Lyman | B41J 2/17566 347/5 |
| 2013/0155138 | A1 * | 6/2013 | Batchelor | B41J 29/02 347/17 |

FOREIGN PATENT DOCUMENTS

| | | |
|---|---|---|
| EP | 2371553 | 10/2011 |
| JP | 06-340089 | 12/1994 |
| JP | 2006-224028 | 8/2006 |
| JP | 2007-160825 | 6/2007 |
| JP | 2007160825 A * | 6/2007 |
| JP | 2008-517809 | 5/2008 |
| WO | 2006-049711 | 5/2006 |

OTHER PUBLICATIONS

European Search Report for Application No. 15193717.4 dated Feb. 25, 2016.

* cited by examiner

*Primary Examiner* — Bradley Thies
(74) *Attorney, Agent, or Firm* — Workman Nydegger

(57) ABSTRACT

A liquid ejecting apparatus includes a liquid path that connects a liquid storage portion for storing liquid and a liquid ejecting portion for ejecting liquid, a receiving tray that is provided on a gravity direction side of the liquid path and is capable of receiving the liquid, and a detector that has a detecting portion for detecting the liquid received on the receiving tray. In the liquid ejecting apparatus, the receiving tray includes a receiving region for receiving the liquid, a detection region in which the detecting portion is arranged so as to make contact with the liquid, and a groove portion formed in the receiving region, and a part of the groove portion makes contact with the detection region.

15 Claims, 7 Drawing Sheets

LIQUID EJECTING APPARATUS WITH INK RECEIVING TRAY AND DETECTOR

BACKGROUND

1. Technical Field

The present invention relates to a liquid ejecting apparatus such as an ink jet printer, for example.

2. Related Art

As examples of existing liquid ejecting apparatuses, there are ink jet printers that perform printing by ejecting ink (liquid) onto a target from liquid ejecting portions. Further, among these printers, there is a printer including a collection portion (receiving tray) for collecting ink which has leaked and a detector for detecting collection of the ink in the collection portion (for example, JP-A-2007-160825).

That is to say, the collection portion includes an absorber for absorbing liquid which has leaked and dropped from the upper side on the overall bottom surface of the printer. The detector detects whether ink has been absorbed and held by the absorber based on change in electric resistance between electrode terminals in accordance with an amount of ink absorbed and held by the absorber.

When ink is absorbed by the absorber, its fluidity is lowered. In particular, when an amount of ink which has leaked is small, the ink is absorbed and held by the absorber at a drop position and does not sufficiently move to a position at which the detector is provided. Due to this, it is difficult for the detector to detect the leakage of a small amount of ink.

Such problem generally occurs not only in the printer including the collection portion for collecting ink but in liquid ejecting apparatuses including receiving trays for receiving liquid.

SUMMARY

An advantage of some aspects of the invention is to provide a liquid ejecting apparatus capable of detecting leakage of a small amount of liquid quickly.

Hereinafter, methods and action effects thereof in order to solve the above-mentioned problem will be described.

A liquid ejecting apparatus according to an aspect of the invention includes a liquid path that connects a liquid storage portion for storing liquid and a liquid ejecting portion for ejecting liquid, a receiving tray that is provided on a gravity direction side of the liquid path and is capable of receiving the liquid, and a detector that has a detecting portion for detecting the liquid received on the receiving tray, where the receiving tray includes a receiving region for receiving the liquid, a detection region in which the detecting portion is arranged so as to make contact with the liquid, and a groove portion formed in the receiving region, and a part of the groove portion makes contact with the detection region.

With this configuration, the receiving tray does not include an absorber for absorbing the liquid in the receiving region. Therefore, fluidity of the received liquid can be maintained. Further, the groove portion a part of which makes contact with the detection region is formed in the receiving region of the receiving tray. This causes the liquid received in the receiving region to flow so as to spread along the groove portion by a capillary phenomenon. Accordingly, even a small amount of liquid received in the receiving region can be guided to the detection region, thereby detecting leakage of the small amount of liquid quickly.

In the above-mentioned liquid ejecting apparatus, it is preferable that the detector further include an absorber capable of absorbing the liquid and the detecting portion and the absorber be arranged adjacent to each other.

With this configuration, the absorber is arranged so as to be adjacent to the detecting portion. Therefore, the liquid guided by the groove portion can be further absorbed by the absorber to be guided to the detecting portion. That is to say, by the detector including the absorber, the size of the absorber can be reduced in comparison with the case where the absorber is provided in the overall receiving region. Accordingly, even a small amount of liquid can be guided to the detecting portion.

In the above-mentioned liquid ejecting apparatus, it is preferable that the absorber be arranged in a state where at least a part of the absorber is compressed.

With this configuration, the absorber is arranged in the state where at least a part of the absorber is compressed. Therefore, even a smaller amount of liquid can be made to reach the detecting portion in comparison with the case where the absorber is arranged in a non-compressed state.

In the above-mentioned liquid ejecting apparatus, it is preferable that the receiving tray have a receiving surface on which the receiving region is provided and the detecting portion be provided so as to penetrate through a surface of the receiving tray on a side of the receiving surface and a rear surface thereof on a side opposite to the receiving surface.

With this configuration, the detecting portion is provided so as to penetrate through the surface on the receiving surface side and the rear surface. Therefore, a portion of the detector, which is different from the detecting portion, can be arranged at the rear surface side of the receiving tray. This can reduce a risk that the liquid attaches to a portion other than the detecting portion and the detector is soiled.

In the above-mentioned liquid ejecting apparatus, it is preferable that the groove portion formed along a guiding direction in which the liquid is guided from the receiving region to the detection region have a width which becomes smaller in a direction intersecting with the guiding direction toward a side of the detection region.

The liquid moves toward the groove portion having a smaller width by the capillary phenomenon. Accordingly, this configuration can move the received liquid toward the detection region side by making the width on the detection region side smaller.

In the above-mentioned liquid ejecting apparatus, it is preferable that the detection region be located on the gravity direction side relative to the receiving region, and the receiving region include a slope having a downward inclination toward the detection region.

With this configuration, the liquid received in the receiving region moves to the detection region so as to descend the slope. Accordingly, the liquid received in the receiving region can be made much easier to move to the detection region.

In the above-mentioned liquid ejecting apparatus, it is preferable that the detection region be located at an end of the receiving tray.

With this configuration, the detection region is located at the end of the receiving tray. This can reduce risks of direct attachment of the liquid which has leaked and dropped from the upper side to the detector and of the detector being soiled.

In the above-mentioned liquid ejecting apparatus, it is preferable that an area of the detection region be smaller than an area of the receiving region.

With this configuration, the area of the detection region is smaller. This can reduce risks of attachment of the liquid to a place which is different from a place to which the liquid is guided from the receiving region and of the detector and the like being soiled.

In the above-mentioned liquid ejecting apparatus, it is preferable that the detector further include an absorber capable of absorbing the liquid, and the absorber be arranged between the receiving region and the detecting portion.

With this configuration, the absorber is arranged between the receiving region and the detecting portion. Therefore, the detecting portion can be provided so as to be separated from the receiving region. That is to say, risks of attachment of the liquid which has leaked and dropped from the upper side to a portion of the detector other than the detecting portion and the absorber and of the detector being soiled can be reduced. Further, when the absorber is arranged between the receiving region and the detecting portion, the size of the absorber can be reduced in comparison with the case where the absorber is provided in the overall receiving region. This can guide even a small amount of received liquid to the detecting portion.

In the above-mentioned liquid ejecting apparatus, it is preferable that the receiving tray have a detecting surface on which the detection region is provided, and the detecting portion be provided so as to be inclined with respect to the detecting surface.

With this configuration, the detecting portion is provided so as to be inclined with respect to the detecting surface. This can limit a portion of the detecting portion to which the liquid guided to the detection region attaches. Accordingly, a risk of the detecting portion being soiled can be reduced.

It is preferable that the above-mentioned liquid ejecting apparatus include a plurality of the receiving trays and a plurality of the detectors.

With this configuration, in the liquid ejecting apparatus, the receiving trays and the detectors can be provided individually at places at which the liquid possibly leaks. Accordingly, a risk that the liquid leaks to the outside of the liquid ejecting apparatus can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings.

A liquid ejecting apparatus is an ink jet printer that performs printing by ejecting ink as an example of liquid onto a target such as paper, for example.

Figure 1:
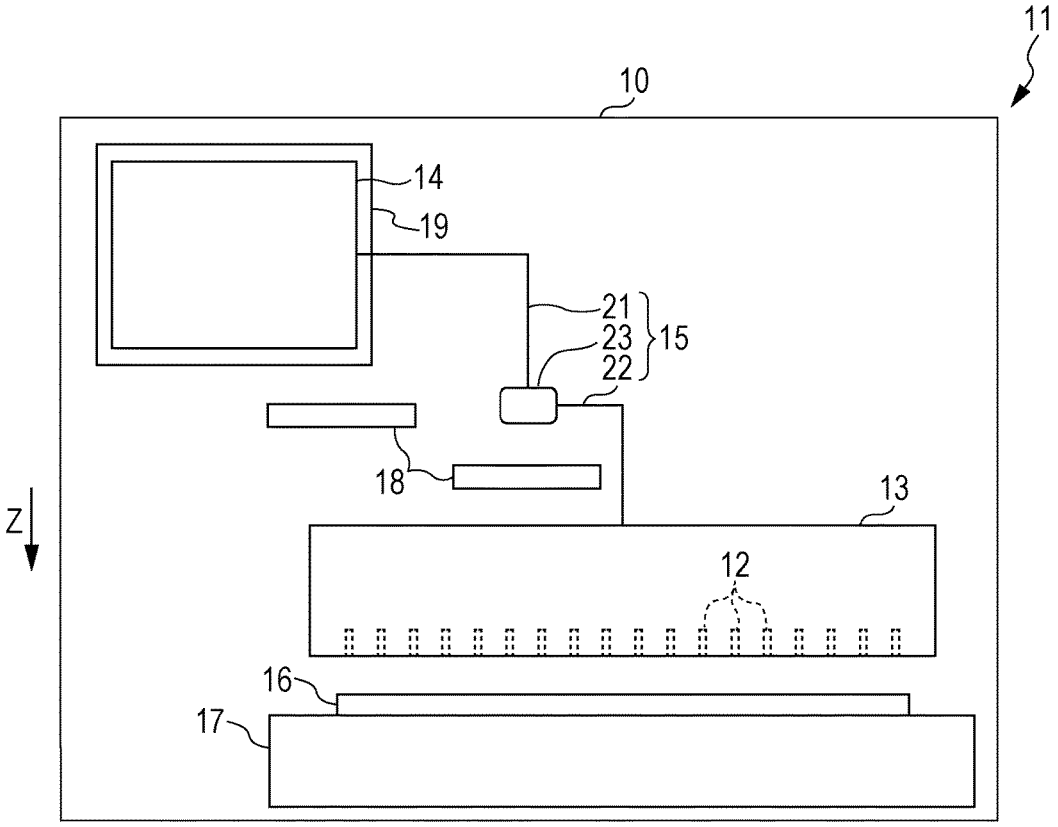
FIG. 1 is a schematic view of a liquid ejecting apparatus according to an embodiment.

As illustrated in FIG. 1, a liquid ejecting apparatus 11 includes a liquid ejecting portion 13, a liquid path 15, and a supporting table 17 in a housing 10 having a substantially rectangular parallelepiped shape. The liquid ejecting portion 13 ejects liquid through a plurality of nozzles 12. The liquid path 15 connects the liquid ejecting portion 13 and a liquid storage portion 14 for storing the liquid. The supporting table 17 supports paper 16 onto which the liquid is ejected from the liquid ejecting portion 13. Further, receiving portions 18 are provided on the gravity direction Z side of the liquid path 15. The receiving portions 18 can receive leaking liquid when the liquid has leaked from the liquid path 15.

The liquid storage portion 14 is an accommodation container capable of accommodating the liquid, for example. The liquid storage portion 14 may be a cartridge replenishing the liquid by exchanging the accommodation container or an accommodation tank fixed to a mounting portion 19. When the liquid storage portion 14 is the cartridge, the mounting portion 19 holds the liquid storage portion 14 in a detachable manner. The mounting portion 19 may have a configuration capable of holding a plurality of liquid storage portions 14 for accommodating different types or colors of liquids, for example.

Further, the liquid path 15 is constituted by a first path portion 21, a second path portion 22, and a connecting member 23. One end of the first path portion 21 is connected to the liquid storage portion 14. One end of the second path portion 22 is connected to the liquid ejecting portion 13. The connecting member 23 connects the other ends of the first path portion 21 and the second path portion 22 to each other. Accordingly, the liquid stored in the liquid storage portion 14 is supplied to the liquid ejecting portion 13 passing through the first path portion 21, the connecting member 23, and the second path portion 22.

The liquid ejecting portion 13 is what-is-called a line head that can eject the liquid at the same time along the width direction (right-left direction in FIG. 1) intersecting with a transportation direction (direction orthogonal to the paper plane in FIG. 1) of the paper 16 which is transported by a transportation mechanism (not illustrated). Therefore, the liquid ejecting portion 13 ejects the liquid toward the paper 16 which passes through in a state of being supported on the supporting table 17.

The receiving portions 18 are provided at a place on the gravity direction Z side of a connection portion of the liquid storage portion 14 and the first path portion 21 and at a place on the gravity direction Z side of the connecting member 23 connecting the first path portion 21 and the second path portion 22. That is to say, the plurality of (two in the embodiment) receiving portions 18 are provided so as to correspond to a plurality of places in the liquid path 15, respectively, at which different members are connected and the liquid possibly leaks.

It should be noted that the configurations of the respective receiving portions 18 are the same and the configuration of one receiving portion 18 will be therefore described below.

Figure 2:
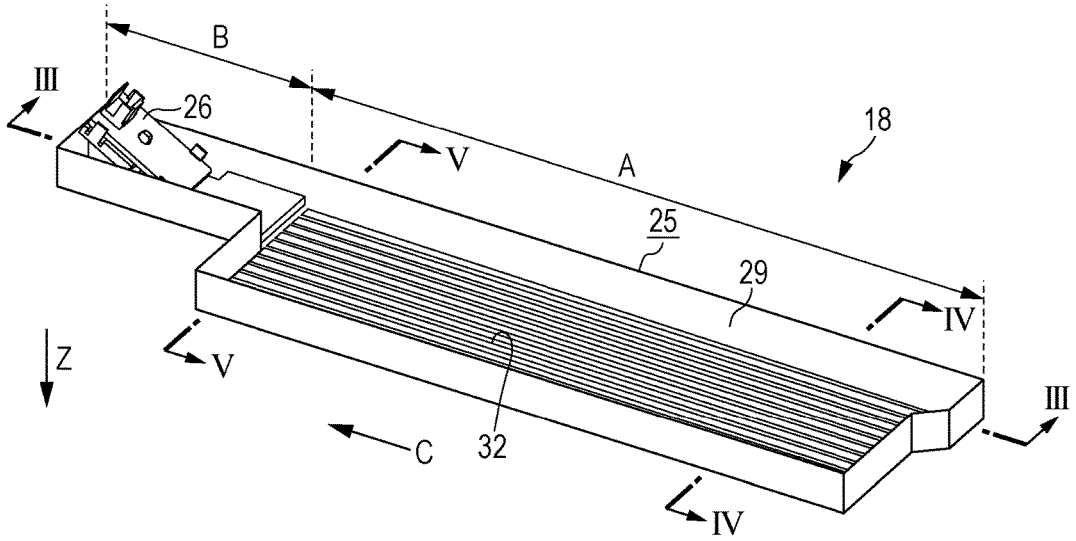
FIG. 2 is a perspective view of a receiving portion.

As illustrated in FIG. 2, each receiving portion 18 includes a receiving tray 25 and a detector 26. The receiving tray 25 can receive the liquid. The detector 26 detects the liquid received on the receiving tray 25. That is to say, the liquid ejecting apparatus 11 includes the plurality of receiving trays 25 and the plurality of detectors 26.

Figure 3:
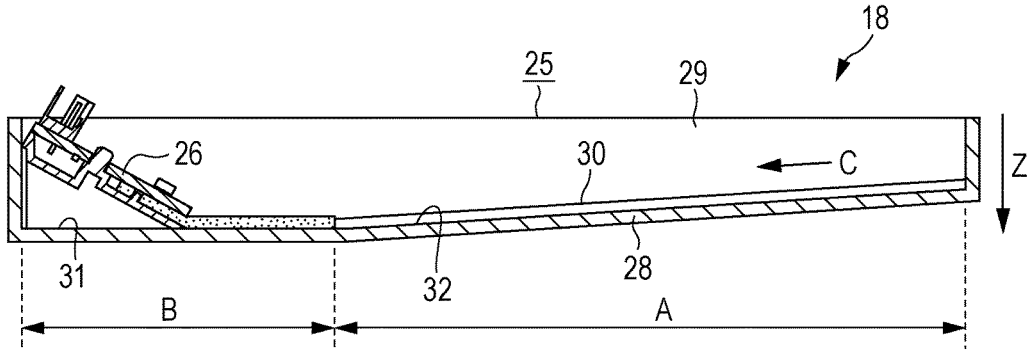
FIG. 3 is a cross-sectional view cut along an arrow III-III in FIG. 2.

As illustrated in FIG. 3, the receiving tray 25 includes a plate-like bottom portion 28 and a wall portion 29 formed so as to be erected from the peripheral edge of the bottom portion 28. Further, the receiving tray 25 has a receiving surface 30 and a detecting surface 31 as surfaces of the bottom portion 28 where the wall portion 29 is erected. A receiving region A for receiving the liquid is provided on the receiving surface 30. A detection region B is provided on the detecting surface 31.

As illustrated in FIG. 2 and FIG. 3, the detection region B is located at an end of the receiving tray 25 and the detector 26 is provided in the detection region B. Further, the area of the detection region B is smaller than the area of the receiving region A.

In the liquid ejecting apparatus 11, each receiving portion 18 is provided such that the receiving region A is located at a position capable of receiving leaking liquid when the liquid has leaked from the liquid path 15. That is to say, the receiving portion 18 is provided such that the receiving region A is located at a position capable of receiving the liquid which has leaked and dropped or a position capable of receiving the liquid which has leaked and flowed downward.

As illustrated in FIG. 3, the receiving portion 18 is provided such that the detection region B is located on the gravity direction Z side relative to the receiving region A. The receiving surface 30 is a slope having a downward inclination toward the detection region B and the receiving region A has a slope. At least one groove portion 32 (in the embodiment, a plurality of groove portions 32) extending along the guiding direction C in which the liquid is guided to the detection region B from the receiving region A is formed in the receiving region A.

The groove portions 32 are formed such that ends of the groove portions 32 on the detection region B side make contact with the detection region B. Some of the groove portions 32 make contact with the detection region B in a state where each of the groove portions 32 are joined on the halfway. That is to say, the groove portions 32 are formed such that parts thereof make contact with the detection region B. Further, the groove portions 32 are formed in the overall receiving region A so as to be aligned in the direction intersecting with the guiding direction C.

Figure 4:
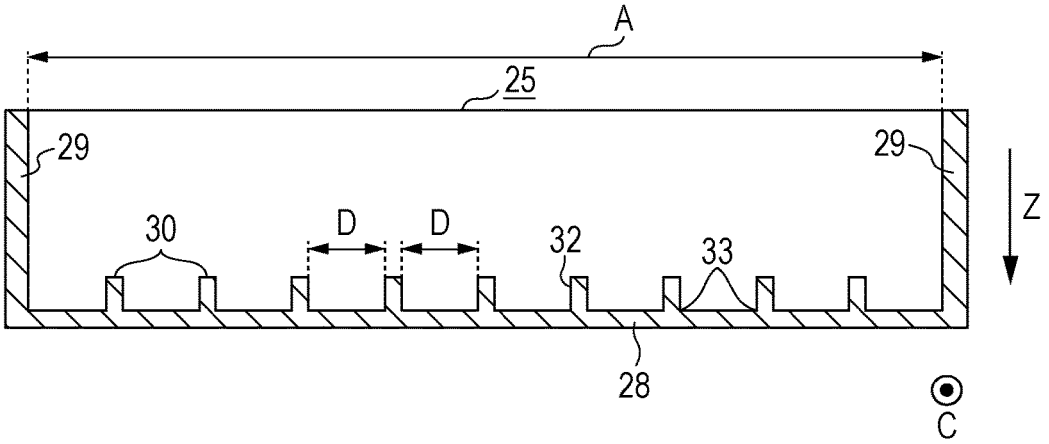
FIG. 4 is a cross-sectional view cut along an arrow IV-IV in FIG. 2.
Figure 5:
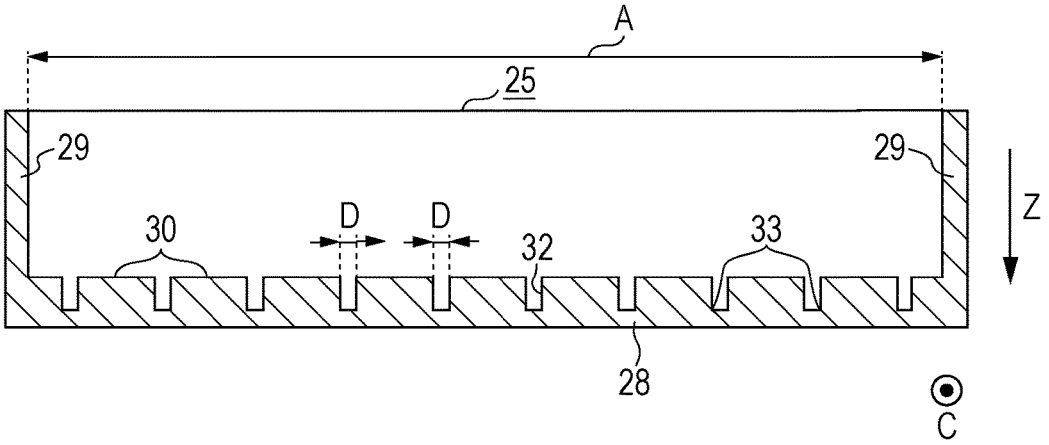
FIG. 5 is a cross-sectional view cut along an arrow V-V in FIG. 2.

As illustrated in FIG. 4 and FIG. 5, the groove portions 32 have widths D which become smaller in the direction intersecting with the guiding direction C toward the detection region B side. The groove portions 32 are formed being recessed from the receiving surface 30 and have cross sections in a rectangular form. Further, the groove portions 32 are formed such that intervals between internal corners 33 of the individual groove portions 32 where the bottom surfaces and the wall surfaces thereof intersect with each other are smaller toward the detection region B. In other words, the widths D of the groove portions 32 are smoothly changed so as to be larger as they are farther from the detection region B and be gradually smaller toward the side closer to the detection region B from the side farther from the detection region B.

Figure 6:
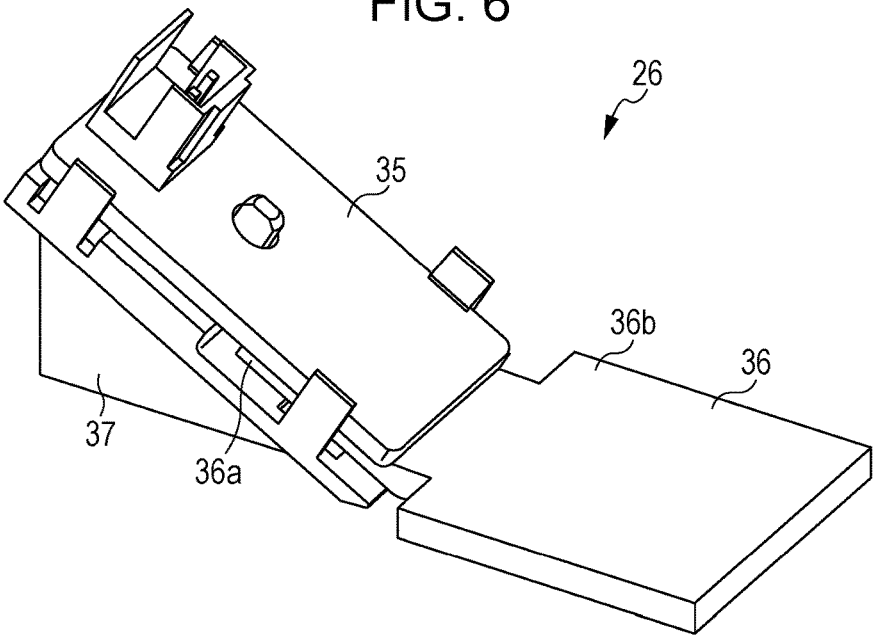
FIG. 6 is a perspective view of a detector.
Figure 7:
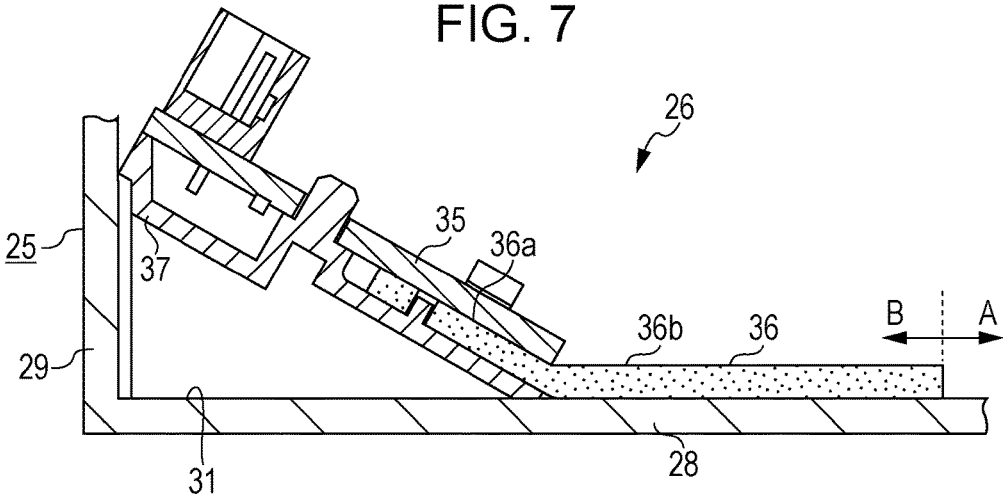
FIG. 7 is a cross-sectional view of a detector.

As illustrated in FIG. 6 and FIG. 7, the detector 26 includes a detecting portion 35, an absorber 36, and a holding portion 37. The detecting portion 35 detects the liquid received on the receiving tray 25. The absorber 36 can absorb the liquid. The holding portion 37 holds the detecting portion 35. That is to say, the detecting portion 35 is arranged in the detection region B so as to make contact with the liquid in a state of being inclined with respect to the detecting surface 31 by being held on the holding portion 37.

The absorber 36 is arranged in a state where a part of it is held between the detecting portion 35 and the holding portion 37 so as to be compressed. That is to say, in the absorber 36, a compression portion **36*a* which is compressed is arranged to be adjacent to the detecting portion 35 while a non-compression portion 36*b* which is not compressed is arranged on the receiving region A side relative to the detecting portion 35 so as to make contact with the receiving region A. In other words, the absorber 36 is arranged between the receiving region A and the detecting portion 35**.

Next, action when liquid has leaked from the liquid path 15 will be described.

When liquid leaks and drops from the liquid path 15, the liquid is received in the receiving region A of the receiving portion 18. Then, the liquid is drawn into the groove portions 32 by the capillary phenomenon and spreads along the groove portions 32. The receiving surface 30 is the slope having the downward inclination toward the detection region B and the widths D of the groove portions 32 are smaller toward the detection region B side. Therefore, the liquid drawn into the groove portions 32 is guided to the detection region B side.

Since parts of the groove portions 32 make contact with the detection region B, the liquid that has flowed to the detection region B in the groove portions 32 is absorbed by the absorber 36 provided in the detection region B. The absorber 36 is provided such that the non-compression portion **36*b* makes contact with the receiving region A. Therefore, the liquid is absorbed by the non-compression portion 36*b* of the absorber 36** first.

Note that the liquid tends to be guided to smaller spaces by the capillary phenomenon. Accordingly, the liquid absorbed by the absorber 36 is guided to the compression portion **36*a* from the non-compression portion 36*b*. Then, the detecting portion 35 that makes contact with the compression portion 36*a*** detects the liquid and a notification portion (not illustrated) notifies a user or the like of the leakage based on information of detection of the liquid.

With the above-mentioned embodiment, the following effects can be obtained.

1. The receiving tray 25 does not include an absorber for absorbing the liquid in the receiving region A. Therefore, fluidity of the received liquid can be maintained. Further, the groove portions 32 parts of which make contact with the detection region B are formed in the receiving region A of the receiving tray 25. This causes the liquid received in the receiving region A to flow so as to spread along the groove portions 32 by the capillary phenomenon. Accordingly, even a small amount of liquid received in the receiving region A can be guided to the detection region B, thereby detecting leakage of the small amount of liquid quickly.

2. The absorber 36 is arranged so as to be adjacent to the detecting portion 35. Therefore, the liquid guided by the groove portions 32 can be further absorbed by the absorber 36 to be guided to the detecting portion 35. That is to say, by the detector 26 including the absorber 36, the size of the absorber 36 can be reduced in comparison with the case where the absorber is provided in the overall receiving region A. Accordingly, even a small amount of liquid can be guided to the detecting portion 35.

3. The absorber 36 is arranged in a state where the compression portion 36*a* is compressed. Therefore, even a smaller amount of liquid can be made to reach the detecting portion 35 in comparison with the case where the absorber 36 is arranged in a non-compressed state.

4. The liquid moves toward the side of the groove portions 32 having smaller widths D by the capillary phenomenon. Accordingly, the received liquid can be moved toward the detection region B side by making the widths D on the detection region B side smaller.

5. The liquid received in the receiving region A moves to the detection region B so as to descend the slope. Accordingly, the liquid received in the receiving region A can be made much easier to move to the detection region B.

6. The detection region B is located at the end of the receiving tray 25. This can reduce risks of direct attachment of the liquid which has leaked and dropped from the upper side to the detector 26 and of the detector 26 being soiled.

7. The area of the detection region B is smaller. This can reduce risks of attachment of the liquid to a place which is different from a place to which the liquid is guided from the receiving region A and of the detector 26 and the like being soiled.

8. The absorber 36 is arranged between the receiving region A and the detecting portion 35. Therefore, the detecting portion 35 can be provided so as to be separated from the receiving region A. That is to say, risks of attachment of the liquid which has leaked and dropped from the upper side to a portion of the detector 26 other than the detecting portion 35 and the absorber 36 and of the detector 26 being soiled can be reduced. Further, when the absorber 36 is arranged between the receiving region A and the detecting portion 35, the size of the absorber 36 can be reduced in comparison with the case where the absorber 36 is provided in the overall receiving region A. This can guide even a smaller amount of received liquid to the detecting portion 35.

9. The detecting portion 35 is provided so as to be inclined with respect to the detecting surface 31. This can limit a portion of the detecting portion 35 to which the liquid guided to the detection region B attaches. Accordingly, a risk of the detecting portion 35 being soiled can be reduced.

10. In the liquid ejecting apparatus 11, the receiving trays 25 and the detectors 26 can be provided individually at places at which the liquid possibly leaks. Accordingly, a risk that the liquid leaks to the outside of the liquid ejecting apparatus 11 can be reduced.

It should be noted that the above-mentioned embodiment may be changed as follows.

Figure 8:
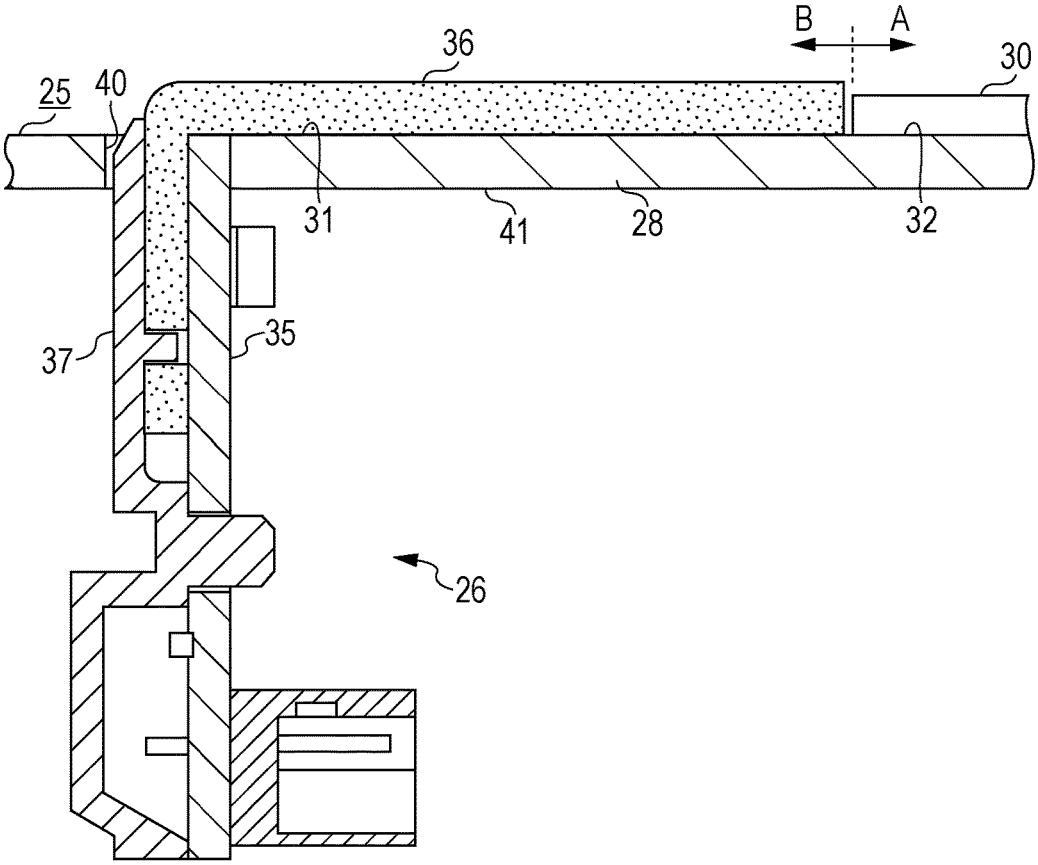
FIG. 8 is a cross-sectional view of a receiving tray and a detector according to a first variation.

As illustrated in FIG. 8, a through-hole 40 may be formed in the bottom portion 28 of the receiving tray 25 and the detector 26 may be inserted through the through-hole 40. That is to say, the detecting portion 35 is provided so as to penetrate through the detection surface 31 of the receiving tray 25 on the receiving surface 30 side and the rear surface 41 on the side opposite to the receiving surface 30 (first variation). Further, only the detecting portion 35 may be inserted through the through-hole 40 with no absorber 36 and no holding portion 37 provided.

With the first variation, the detecting portion 35 is provided so as to penetrate through the detection surface 31 on the receiving surface 30 side and the rear surface 41, thereby arranging a portion of the detector 26, which is different from the detecting portion 35, on the rear surface 41 side of the receiving tray 25. Accordingly, risks of attachment of the liquid to a portion other than the detecting portion 35 and of the detector 26 being soiled can be reduced.

Figure 9:
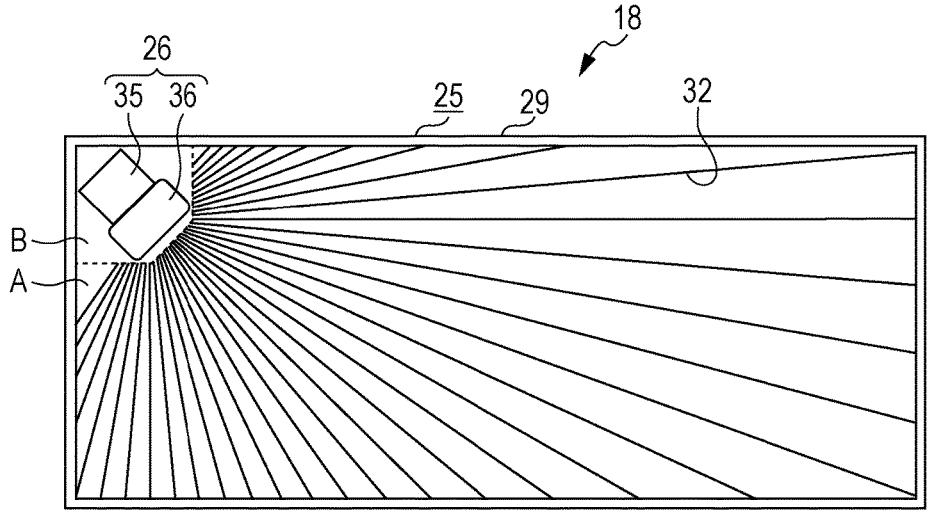
FIG. 9 is a plan view of a receiving portion according to a second variation.

As illustrated in FIG. 9, the detector 26 may be provided in one internal corner of the receiving tray 25 as the detection region B, and the groove portions 32 may be formed so as to extend in a radial form about the detection region B (second variation). That is to say, the detection region B may be provided at a position making contact with two surfaces of the wall portion 29.

Figure 10:
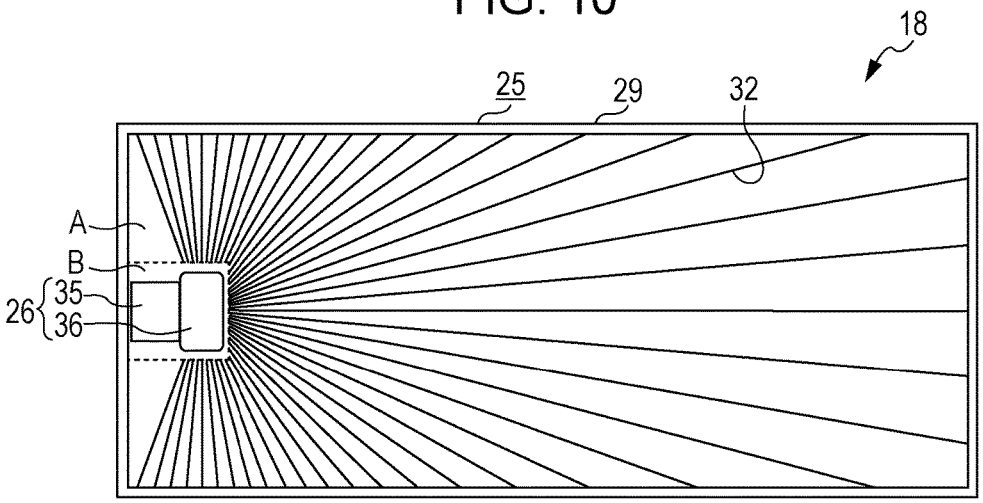
FIG. 10 is a plan view of a receiving portion according to a third variation.

As illustrated in FIG. 10, the detection region B may be provided at a position making contact with one surface of the wall portion 29 (third variation).

Figure 11:
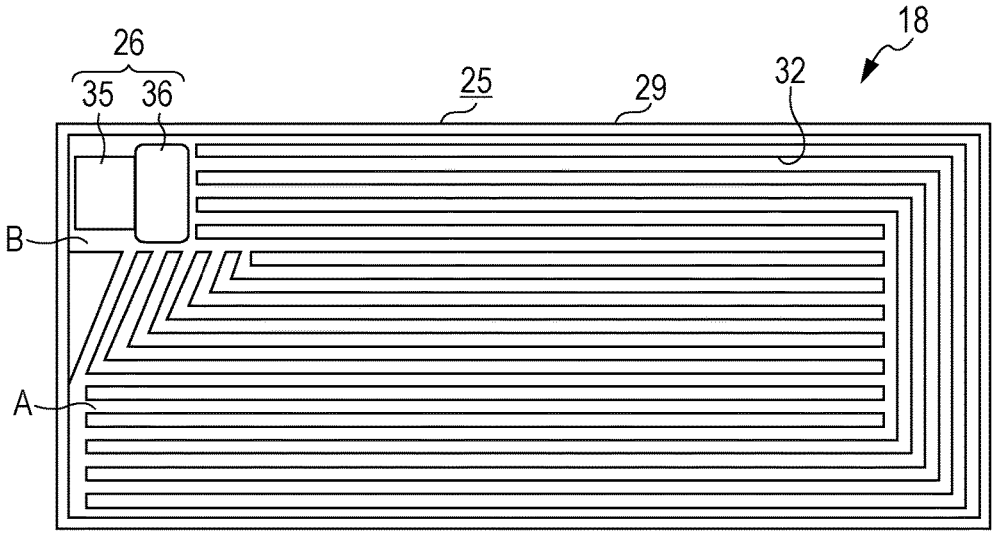
FIG. 11 is a plan view of a receiving portion according to a fourth variation.

As illustrated in FIG. 11, the groove portions 32 are not limited to be linear and may have bending shapes (fourth variation). For example, the groove portions 32 may have folded shapes, curved shapes, or serpentine shapes. Further, one groove portion 32 may be formed by combining these shapes.

Figure 12:
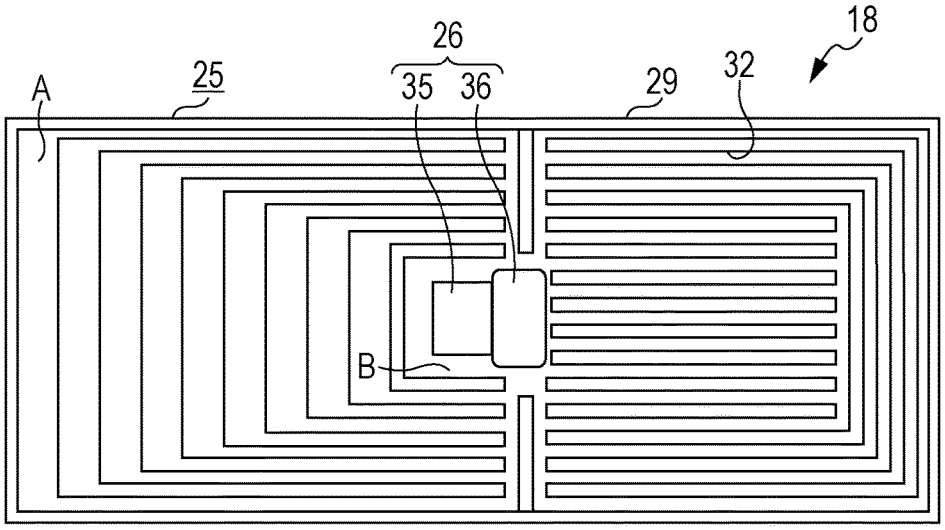
FIG. 12 is a plan view of a receiving portion according to a fifth variation.

As illustrated in FIG. 12, the detection region B may be provided at the center of the receiving tray 25 (fifth variation). Further, the widths D of parts of the groove portions 32 may be larger and the widths D of other parts may be smaller, where the widths D of the groove portions 32 do not change smoothly.

In the above-mentioned embodiment and each of the above-mentioned variations, the groove portions 32 may not be formed in the overall receiving region A but formed in only a part of the receiving region A.

In the above-mentioned embodiment and each of the above-mentioned variations, the liquid ejecting apparatus 11 may include one receiving portion 18. Alternatively, the liquid ejecting apparatus 11 may include equal to or more than two receiving portions 18. Further, each receiving portion 18 may be provided so as to correspond to a plurality of places at which the liquid possibly leaks.

In the above-mentioned embodiment and each of the above-mentioned variations, the detector 26 may include no holding portion 37. That is to say, the detecting portion 35 may be arranged directly on the detecting surface 31 and the detecting portion 35 may not be inclined with respect to the detecting surface 31.

In the above-mentioned embodiment and each of the above-mentioned variations, the absorber 36 may not be arranged between the detecting portion 35 and the receiving region A. That is to say, for example, the absorber 36 may be arranged on the detecting surface 31 and the detecting portion 35 may be further arranged on the absorber 36.

In the above-mentioned embodiment and each of the above-mentioned variations, the area of the detection region B may be the same as the area of the receiving region A. Alternatively, the area of the receiving region A may be made smaller than the area of the detection region B.

In the above-mentioned embodiment and each of the above-mentioned variations, the detection region B may have the same height as that of the receiving region A in the gravity direction Z. That is to say, the receiving region A may not include the slope. Further, the receiving tray 25 may be formed such that the overall receiving surface 30 is not formed as the slope but only the bottom surfaces in the groove portions 32 may be formed as slopes. That is to say, the groove portions 32 may be formed to be shallower as they are farther from the detection region B and to be deeper as they are closer to the detection region B. Further, only a part of the receiving region A may be formed as the slope.

In the above-mentioned embodiment and each of the above-mentioned variations, the widths D of the groove portions 32 may be constant in the guiding direction C.

In the above-mentioned embodiment and each of the above-mentioned variations, the absorber 36 may not have the compression portion 36*a*. Further, the absorber 36 may be compressed by the detecting surface 31 of the receiving tray 25 and the detecting portion 35, or the overall absorber 36 may be formed as the compression portion 36*a*.

In the above-mentioned embodiment and each of the above-mentioned variations, the detector 26 may not include the absorber 36. Further, the absorber 36 may not be arranged so as to be adjacent to the detecting portion 35. For example, a photoelectric sensor may be used as the detector 26 so as to detect liquid based on reflected light that fluctuates depending on the presence/absence of the liquid.

In the above-mentioned embodiment and each of the above-mentioned variations, the groove portions 32 may be formed to have substantially V-shaped cross sections such that the wall surfaces thereof are formed obliquely and make contact with each other on the bottom surfaces thereof or substantially U-shaped cross sections such that the bottom surfaces are curved.

In the above-mentioned embodiment and each of the above-mentioned variations, a plurality of projections may be formed on the receiving surface 30 and portions between the projections may be defined as the groove portions 32. That is to say, the bottom surfaces of the groove portions 32 may be used as the receiving surfaces 30.

In the above-mentioned embodiment and each of the above-mentioned variations, a lower portion of the housing 10 in the liquid ejecting apparatus 11 may also serve as the receiving tray 25.

In the above-mentioned embodiment and each of the above-mentioned variations, the groove portions 32 may be formed so as to extend across the receiving region A and the detection region B.

In the above-mentioned embodiment, the liquid ejecting apparatus may be a liquid ejecting apparatus that ejects or discharges liquid other than ink. The state of the liquid which is discharged from the liquid ejecting apparatus as a trace amount of liquid droplets includes a granule form, a teardrop form, and a form that pulls tails in a string-like form therebehind. It is sufficient that the "liquid" referred herein is a material which can be ejected from the liquid ejecting apparatus. For example, any materials are used as long as the materials are in a liquid phase. For example, materials in a liquid state having high viscosity or low viscosity, sol, gel water, other inorganic solvents, an organic solvent, a solution, a liquid resin, and a fluid state material such as a liquid metal (molten metal) can be included as the liquid. Further, the liquid is not limited to liquid as one state of a material and includes liquid in which the particles of a functional material made of a solid material such as pigment or metal particles are dissolved, dispersed, or mixed in a solvent. Representative examples of the liquid are ink described in the above-mentioned embodiment, liquid crystals, and the like. The "ink" herein encompasses common aqueous ink and oil ink, as well as various liquid compositions such as gel ink and hot melt ink. Specific examples of the liquid ejecting apparatus include a liquid ejecting apparatus which ejects liquid containing a material such as an electrode material or a coloring material in a dispersed or dissolved state. The material such as the electrode material or the coloring material is used for manufacturing a liquid crystal display, an electroluminescence (EL) display, a surface emitting display or a color filter, for example. Further, the specific examples of the liquid ejecting apparatus include a liquid ejecting apparatus which ejects a bioorganic material to be used for manufacturing a biochip, a liquid ejecting apparatus which is used as a precision pipette and ejects liquid as a sample, a printing device, and a micro dispenser. Other examples of the liquid ejecting apparatus include a liquid ejecting apparatus which pinpoint-ejects lubricating oil to a precision machine such as a watch or a camera. Further, a liquid ejecting apparatus which ejects a transparent resin solution of an ultraviolet curing resin or the like onto a substrate in order to form a hemispherical microlens (optical lens) to be used for an optical communication element and the like is included as the liquid ejecting apparatus. In addition, a liquid ejecting apparatus which ejects an acid or alkali etching solution for etching a substrate or the like may be employed as the liquid ejecting apparatus.

The entire disclosure of Japanese Patent Application No. 2014-227809, filed Nov. 10, 2014 is expressly incorporated by reference herein.

What is claimed is:

1. A liquid ejecting apparatus comprising:

a liquid path that connects a liquid storage portion for storing liquid and a liquid ejecting portion for ejecting liquid;

a receiving tray that is provided on a gravity direction side of the liquid path and is capable of receiving the liquid; and a detector that has a detecting portion for detecting the liquid received on the receiving tray, wherein the receiving tray includes:

a receiving region for receiving the liquid, wherein the receiving region is provided on a receiving surface of the receiving tray;

a detection region in which the detecting portion is arranged so as to make contact with the liquid; and a groove portion that is formed in the receiving region and includes a plurality of grooves, wherein the receiving surface of the receiving tray does not include an absorber such that the received liquid is guided to the detection region by the groove portion without any of the liquid being absorbed prior to the detection region, wherein a part of the groove portion makes contact with the detection region.

2. The liquid ejecting apparatus according to claim 1, wherein the detector further includes an absorber capable of absorbing the liquid, and the detecting portion and the absorber are arranged adjacent to each other.

3. The liquid ejecting apparatus according to claim 2, wherein the absorber is arranged in a state where at least a part of the absorber is compressed.

4. The liquid ejecting apparatus according to claim 1, wherein the receiving tray has a receiving surface on which the receiving region is provided, and the detecting portion is provided so as to penetrate through a surface of the receiving tray on a side of the receiving surface and a rear surface of the receiving tray on a side opposite to the receiving surface.

5. The liquid ejecting apparatus according to claim 1, wherein each of the plurality of grooves formed along a guiding direction in which the liquid is guided from the receiving region to the detection region has a width which becomes smaller in a direction intersecting with the guiding direction toward a side of the detection region.

6. The liquid ejecting apparatus according to claim 1, wherein the detection region is located on the gravity direction side relative to the receiving region, and the receiving region includes a slope having a downward inclination toward the detection region.

7. The liquid ejecting apparatus according to claim 1, wherein the detection region is located at an end of the receiving tray.

8. The liquid ejecting apparatus according to claim 1, wherein an area of the detection region is smaller than an area of the receiving region.

9. The liquid ejecting apparatus according to claim 1, wherein the detector further includes an absorber capable of absorbing the liquid, and the absorber is arranged between the receiving region and the detecting portion.

10. The liquid ejecting apparatus according to claim 1, wherein the receiving tray has a detecting surface on which the detection region is provided, and the detecting portion is provided so as to be inclined with respect to the detecting surface.

11. The liquid ejecting apparatus according to claim 1, further including a plurality of the receiving trays and a plurality of the detectors.

12. The liquid ejecting apparatus according to claim 1, wherein the receiving tray includes a bottom portion and a wall portion which is formed so as to be erected from the peripheral edge of the bottom portion, wherein the detection region is provided at a position making contact with one surface of the wall portion.

13. The liquid ejecting apparatus according to claim 1, wherein the detector has a leading portion which leads the liquid to the detecting portion, wherein the detecting portion is disposed at a position higher than a lowest portion of the receiving region.

14. A liquid ejecting apparatus comprising:

a liquid path that connects a liquid storage portion for storing liquid and a liquid ejecting portion for ejecting liquid;

a receiving tray that is provided on a gravity direction side of the liquid path and is capable of receiving the liquid, wherein the receiving tray includes a bottom portion; and a detector that has a detecting portion for detecting the liquid received on the receiving tray, wherein the receiving tray includes:

a receiving region for receiving the liquid;

a detection region in which the detecting portion is arranged so as to make contact with the liquid; and a plurality of projections which is formed on the bottom portion, wherein portions between the plurality of the projections are included in the receiving region, the portions between the plurality of projections defining a groove portion that provide the received liquid from the receiving region to the detection region.

15. A liquid ejecting apparatus comprising:

a liquid path that connects a liquid storage portion for storing liquid and a liquid ejecting portion for ejecting liquid;

a receiving tray that is provided on a gravity direction side of the liquid path and is capable of receiving the liquid; and a detector that has a detecting portion for detecting the liquid received on the receiving tray, wherein the receiving tray includes:

a receiving region for receiving the liquid, wherein the receiving region is provided on a receiving surface of the receiving tray;

a detection region in which the detecting portion is arranged so as to make contact with the liquid, wherein at least a portion of the receiving region is sloped in a vertical direction toward the detection region; and a groove portion formed in the receiving region, wherein the receiving surface of the receiving tray does not include an absorber such that the received liquid is guided to the detection region by the groove portion without any of the liquid being absorbed prior to the detection region, and a part of the groove portion makes contact with the detection region.

* * * * *